United States Patent [19]

McClaflin et al.

[11] Patent Number: 4,605,069

[45] Date of Patent: Aug. 12, 1986

[54] METHOD FOR PRODUCING HEAVY, VISCOUS CRUDE OIL

[75] Inventors: Gifford G. McClaflin; Henry A. Bourne; Donald L. Whitfill, all of Ponca City, Okla.

[73] Assignee: Conoco Inc., Ponca City, Okla.

[21] Appl. No.: 658,720

[22] Filed: Oct. 9, 1984

[51] Int. Cl.[4] ..... E21B 43/00; F04F 5/02

[52] U.S. Cl. ..... 166/310; 166/68; 166/370; 166/372; 417/55; 417/172

[58] Field of Search ..... 166/68, 68.5, 362, 244 C, 166/250, 310, 312, 369, 370, 371, 372; 417/55, 172; 137/13; 252/8.55 R

[56] References Cited

U.S. PATENT DOCUMENTS

| | | | |
|---|---|---|---|
| 2,291,911 | 8/1942 | McMahon | 417/172 |
| 2,368,346 | 1/1945 | Coberly | 166/310 |
| 3,033,784 | 5/1962 | Jones | 166/244 C X |
| 3,380,531 | 4/1968 | McAuliffee et al. | 166/371 |
| 3,455,394 | 7/1969 | Knight | 166/371 |
| 3,467,195 | 9/1969 | McAuliffee et al. | 166/371 |
| 4,213,934 | 7/1980 | Bellos et al. | 166/244 C X |
| 4,249,554 | 2/1981 | McClafin | 252/8.55 R X |
| 4,310,288 | 1/1982 | Erikson | 417/172 X |
| 4,354,553 | 10/1982 | Hensley | 166/250 X |
| 4,504,195 | 3/1985 | Binks et al. | 417/172 |

FOREIGN PATENT DOCUMENTS

| | | | |
|---|---|---|---|
| 652315 | 3/1979 | U.S.S.R. | 166/244 C |

OTHER PUBLICATIONS

Simon et al., Down-Hole Emulsification for Improving Viscous Crude "Production", *Journal of Petroleum Technology,* Dec. 1968, pp. 1349–1353.

*Primary Examiner*—George A. Suchfield
*Attorney, Agent, or Firm*—Stephen A. Littlefield

[57] ABSTRACT

Disclosed is a process whereby heavy, viscous crude oil may be produced from a hydrocarbon-bearing formation utilizing a jet pump without the problems associated with cavitation damage of the jet pump found in the prior art. The jet pump is operated with a power fluid comprising water and surfactant, the power fluid forming an emulsion with the heavy, viscous crude oil in the jet stream of the jet pump.

11 Claims, 2 Drawing Figures

METHOD FOR PRODUCING HEAVY, VISCOUS CRUDE OIL

This invention relates to the art of oil production, and more particularly to a process for economically and efficiently producing heavy, viscous crude oil utilizing a jet pump.

BACKGROUND OF THE INVENTION

A large amount of the world's oil comprises heavy, viscous crude oil having an API gravity of less than about 15°. With the gradual depletion of higher gravity, more easily produced crude oils, the recovery of these viscous, heavy crudes becomes increasingly important.

In order to produce such heavy, viscous crudes, several means have been developed for lowering the viscosity of the crude so that production by normal pumping equipment can be accomplished. One method involves the dilution of the viscous crude with a lighter, higher gravity crude or a hydrocarbon diluent such as kerosene distillate, or diesel fuel. Such dilution effectively raises the gravity of the heavy crude so that it may be economically produced by common oil field procedures. The main drawback of this procedure is that valuable fluids must be pumped downhole in order to produce less valuable fluids. The economic break point of such a procedure is high.

Another method for producing heavy, viscous crude oil involves the heating of the crude oil in place in the formation to lower the viscosity of the oil. Injection of hot fluids such as steam and/or water or the actual burning of some of the oil in place has been utilized to accomplish such formation heating. Specialized equipment must be utilized for producing such oil since the viscosity will again increase if it is allowed to cool. Therefore, it is necessary to utilize specially constructed, insulated tubing in the well bore to retain as much heat as possible to allow high temperature production. The economic break-even point of such a system is also high because large amounts of energy must be consumed in the heating process.

Another method for producing heavy, viscous crude is through emulsification with water and surfactant downhole so that the oil can be produced as a low viscosity, oil-in-water emulsion. In such processes, a water and surfactant solution is admitted to the well bore where it mixes with the heavy, viscous crude within or adjacent to a downhole pump. The emulsion is then formed through the agitation and movement of the mixture induced by the reciprocating action of the downhole pump. U.S. Pat. Nos. 3,380,531 and 3,467,195 describe the details of these processes. Such systems as described in these patents have been further defined through the use of any of a large number of specific surfactant types which increase the efficiency of the emulsification process. U.S. Pat. Nos. 4,108,193 and 4,249,554 are illustrative of these refined processes.

The major difficulty with these emulsification processes is that mixing of the aqueous surfactant solution with the heavy, viscous crude is often incomplete with the action of merely a reciprocating pump. This problem was addressed in the aforementioned U.S. Pat. No. 3,380,531 by utilizing the disclosed surfactant and water solution as a power fluid for operating a downhole hydraulic piston pump and exhausting the used power fluid into a mixing chamber located upstream in the flow path for the crude as it approached the reciprocating pump. Such pre-mixing increased the efficiency of the crude oil emulsification to some degree.

Jet-action pumps have been used for producing water and/or oil from subterranean formations. U.S. Pat. No. 4,135,861 describes one form of such a jet pump. A typical jet pump is manufactured by KOBE Inc. and is generally described in their Bulletin 200-06. In the operation of a jet pump, a power fluid is jetted through a nozzle in the flow path of a well fluid. The well fluid is entrained in the jet stream and thereby powered to the surface. Such jet pumps offer many advantages in that they have no moving parts thereby simplifying maintenance; they can be utilized with existing tubing with setting and retrieval being accomplished by standard wire line running and retrieving tools. Previously, however, such jet pumps have never been successfully employed in producing heavy, viscous crudes. The primary difficulty being cavitation of well gases in the throat area of the pump adjacent the high pressure power fluid jet. Such cavitation is apparently the result of the slow movement of the heavy, viscous crude into the throat area. The result of such cavitation is severe erosion of the pump throat within a matter of hours following start-up of the jet pump.

SUMMARY OF THE INVENTION

The present invention provides a process whereby heavy, viscous crude oil may be produced from a hydrocarbon-bearing formation utilizing a jet pump while avoiding the severe cavitation damage to the pump which was common in prior attempts to produce heavy crude with a jet pump.

In accordance with the invention, a method for producing hydrocarbon liquid from a hydrocarbon-bearing formation wherein the hydrocarbon liquid is propelled to the surface by a jet pump utilizing a high pressure, jetted power fluid which entrains the hydrocarbon liquid in a jet stream includes the improvement of providing a power fluid comprising a water and surfactant solution and emulsifying the hydrocarbon liquid in the water and surfactant solution in the jet stream of the jet pump whereby heavy, viscous hydrocarbon liquids can be economically produced as an oil-in-water emulsion.

Further in accordance with the invention, the above-noted jet pump apparatus can be used with annulus pressure operated drill stem test tools to test a heavy, viscous crude oil reservoir in offshore environments.

It is therefore an object of this invention to provide a means and method whereby heavy, viscous crude oil may be economically produced utilizing a jet pump.

It is yet another object of this invention to provide a means and method whereby heavy, viscous crude oil may be produced from subsea formations through non-insulated risers passing through low sea water temperature zones.

It is yet another object of this invention to provide a means and method whereby a drill stem test can be conducted utilizing a jet pump to test the production of a heavy, viscous crude oil.

BRIEF DESCRIPTION OF THE DRAWINGS

These and other objects of the invention will become apparent to those skilled in the art once they have appreciated the concepts of this invention as described in this specification and as illustrated in the accompanying drawings forming a part thereof and in which.

DETAILED DESCRIPTION OF THE PREFERRED EMBODIMENTS AND THE DRAWINGS

Figure 1:
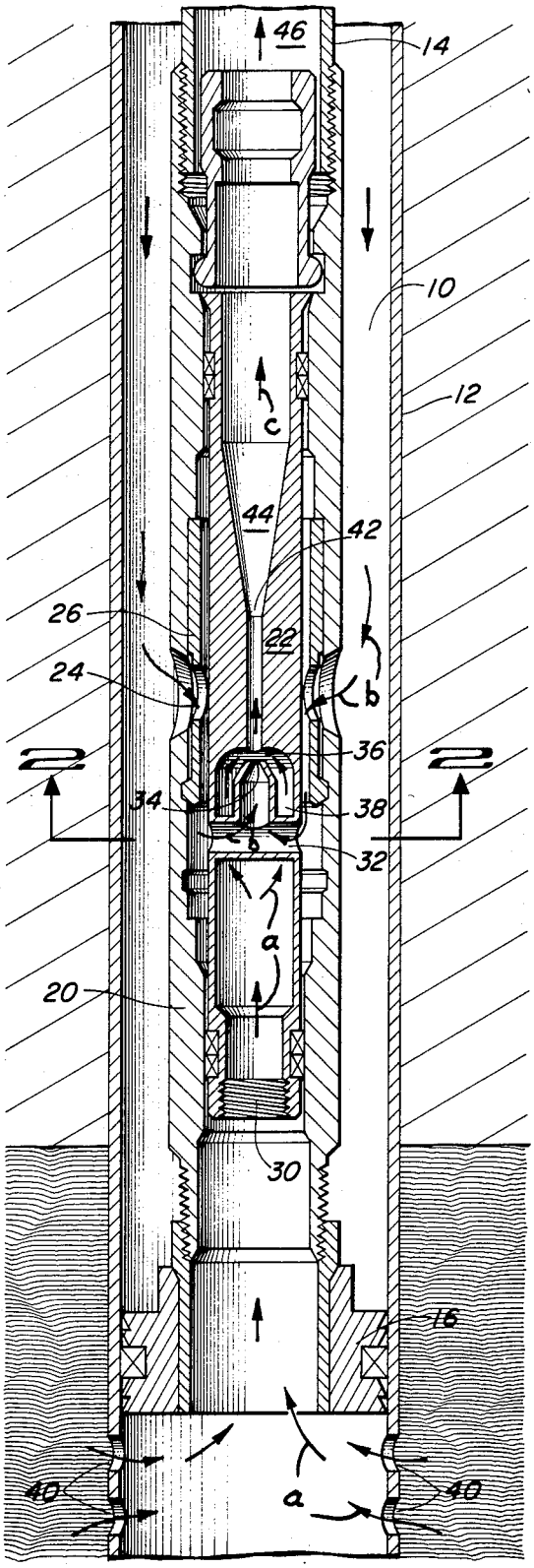
FIG. 1 is a schematic cross-sectional view of a well bore and jet pump which is operated in accordance with the method of the present invention.

Jet pumps have long been known for use in producing subterranean liquids such as water and high gravity crude oil. The pump offers the advantage that it can be run into and removed from the well bore through production tubing utilizing standard running and retrieving tools. The figures illustrate the operation of a so-called reverse circulation jet pump such as that sold by KOBE Inc. as the Type SSJ reverse circulation jet pump. In the operation of a reverse circulation type jet pump illustrated in the Figures, power fluid is admitted under pressure to an annular space 10 between the well casing 12 and the production tubing 14. The annular space 10 is closed off at its lower end by a packer and seal assembly 16. In the preferred installation shown, a sliding sleeve bOdy 20 is fitted on the lower end of the production tubing 14 and made up with appropriate threaded connectors to the packer and seal assembly 16. The sliding sleeve body 22 has means for receiving the jet pump 20 to within its interior. Sleeve openings 24 are provided for admitting power fluid to the interior of the sleeve body 20 from the annular space 10. A sliding sleeve 26 may also be provided to close off fluid communication through sleeve openings 24 if this should for any reason be desirable.

The jet pump includes a well fluid inlet port 30 and power fluid inlet ports 32, for admitting power fluid to a jet nozzle 34 which discharges into a throat area 36 of the jet pump assembly 22. Well fluid passages 38 are provided in fluid communication with the well fluid inlet port 30 for admitting well fluid to the throat area 36.

In the operation of the jet pump, well fluids flow under formation pressure in the direction of arrows a to the well fluid inlet port 30 from the interior of the well casing 12 below the packer and seal assembly 16, the well fluid being admitted through the perforations 40 in the well casing 12. Power fluid under high pressure in the annular space 10 passes in the direction of the arrows b through the sleeve openings 24 and into the jet nozzle 34 through the power fluid inlet ports 32. The power fluid is jetted from the nozzle 34 into a high velocity passage 42 of the jet pump assembly 22 where the power fluid is violently mixed with the well fluid in the throat area 36 as well as in the high velocity passage 42. The mixed power fluid and well fluid then proceeds in the direction of arrows c into the enlarged diameter passage 44 and therefrom into the interior 46 of the production tubing 14 which extends to the production equipment at the surface.

Cavitation is a destructive phenomenon which results from an imbalance of power fluid pressure at the jet nozzle and well fluid pressure within the formation but particularly within the pump body such as within the well fluid passages 38 and in the throat 36. In accordance with Bernoulli's principle, the high velocity of the fluid within the throat area 36 and the high velocity passage 42 which is produced by the high pressure power fluid jet results in lower pressure in these areas. If the well fluid is of low viscosity such as water or light crude oil, there is little problem with the well fluid being forced into the throat area 36 of the jet pump 22 by the pressure differential created by the jet. However, a highly viscous well fluid may not be capable of sufficient flow velocity through the well fluid inlet port 30 and the well fluid passages 38 to adequately supply the low pressure area adjacent the power fluid jet unless there is a relatively high formation pressure driving the viscous well fluid in that direction. If there is insufficient formation pressure differential for driving a viscous well fluid to the pump, cavitation in the throat area 36 can result through the repeated formation of a partial vacuum and the collapse of the vacuum in the liquid mixture. Such cavitation can result in severe erosion of the throat area 36 and the high velocity passage 42 despite the fact that these metal parts are commonly made with extremely hard material such as metal carbides or ceramics. As stated previously, prior attempts to utilize the above-described jet pump system to produce a heavy, viscous crude oil utilizing water or a light fluid hydrocarbon power fluid such as kerosene distillate have resulted in such severe cavitation damage to the jet pump in such a short period of time as to render the process uneconomic.

The present invention results in a method whereby heavy, viscous crude oil may be produced advantageously with a jet pump while severe cavitation damage normally experienced with the jet pump in such use is greatly reduced.

In accordance with the invention, the power fluid for producing heavy, viscous crude oil utilizing a jet pump comprises a water solution of a surfactant or blend of surfactants either alone or with a hydrocarbon diluent. The prior art describes a broad range of surfactant types including anionic and non-ionic surfactants as well as blends of such surfactants for the emulsification of heavy crude oil in various reciprocating pumping systems. It has now been found that, in contravention of prior beliefs regarding the operation of a jet pump, the use of such aqueous surfactant solutions in a jet pump for the production of heavy, viscous crude oil greatly reduces the expected damage to the jet pump due to cavitation.

Figure 2:
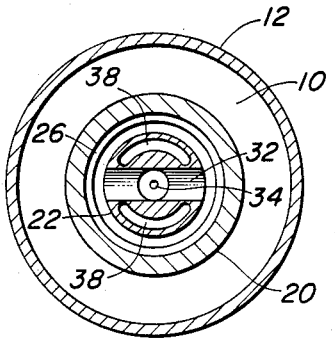
FIG. 2 is a cross-sectional view of the jet pump of FIG. 1 showing the fluid passages of the pump taken generally in the position 2—2 thereof.

A number of tests were conducted in the Cat Canyon Field, Santa Maria, Calif. utilizing a jet pump similar that shown in FIGS. 1 and 2. The tests were conducted in an existing well in which 8° API gravity heavy, viscous crude oil is produced from a Monterey Miocene formation. The bottom hole pressure was approximately 150 psi at a temperature of 150° F. The jet pump power fluid comprised an aqueous solution of surfactant in the range of about 50 to greater than 250 ppm as well as about 100 ppm biocide, about 70 ppm oxygen scavenger, and about 10 ppm scale inhibitor. The preferred biocide used was gluteraldehyde; the preferred oxygen scavenger used was ammonium bisulfite and the preferred scale inhibitor used was polyacrylamide. The power fluid was injected into the annular space 10 (FIG. 1) at a rate such that the ratio of water to produced crude oil was approximately 7.25 to 1. It will be understood that the ratio of water to produced crude may be adjusted over a wide range to give optimum pumping performance. The only limitations on the water-to-oil ratio are economics and the lower limit of water necessary to avoid inversion of the oil-in-water emulsion to a water-in-oil emulsion.

The preferred surfactant utilized in the above formulation comprised a 50-50 blend of an ethoxylated nonyl phenol containing 50 ethoxylate groups and a sodium salt of an ethoxylated alcohol ether sulfate having 4 ethoxylate groups per mole of alcohol. It will be understood that while this blend of surfactants was preferred, each of the surfactants utilized independently would perform sufficiently well to be economic in the disclosed jet pump system. Further, other similar surfactant material found in the prior art for emulsifying heavy crude oil may be advantageously employed in the process of the present invention.

EXAMPLE 1

A jet pump power fluid comprising ocean water containing 120 ppm surfactant, 60 ppm biocide, 70 ppm oxygen scavenger, and 10 ppm scale inhibitor was injected at a rate so that the produced emulsion had a ratio of about 7.25 to 1 water to oil. The test was continued for a period of about five hours with no difficulty in oil production. However, separator equipment at the surface was unable to handle the 8° API gravity crude without difficulty. As a result, kerosene distillate was added at the surface to increase the API gravity to a level at which the surface separator equipment could operate.

EXAMPLE 2

The jet pump was operated utilizing the aqueous power fluid of Example 1 in a mixture with kerosene distillate such that the rate of injection of kerosene distillate would be 50 barrels per day. The test was conducted for approximately eight hours. The jet pump system produced the 8° heavy, viscous crude oil without difficulty utilizing this system and the dilution effect of the kerosene distillate overcame the problems with the operation of the surface separator equipment.

EXAMPLE 3

The jet pump power fluid and diluent mixture of Example 2 was repeated with the substitution of No. 2 diesel for kerosene distillate and the biocide concentration was increased to 100 ppm. The test was continued for approximately eight hours with results being substantially similar to those of Example 2.

EXAMPLE 4

The jet pump was operated for three 24 hour periods utilizing a power fluid comprising ocean water containing 100 ppm biocide, 70 ppm oxygen scavenger, 10 ppm scale inhibitor and 150 ppm, 160 ppm and 250 ppm of surfactant for each of the three days, respectively. The jet pump system operated without incident to produce the 8° API gravity heavy, viscous crude oil.

EXAMPLE 5

The jet pump was operated with the power fluid of Example 3 with a standard drill stem test tool string operating on annulus pressure in place below the jet pump, the testing continuing for a period of about 10 hours. No difficulty was encountered in the use of this jet pump system in conjunction with drill stem test tools.

Testing of various power fluid formulations was continued until a total of over 100 hours was accumulated in the operation of the jet pump. An inspection of the throat area 36 (FIG. 1) of the jet pump revealed only minute pitting resulting from cavitation during the testing operations. This is well below the damage expectations of those skilled in the art who predicted destruction of the jet pump throat within the matter of a few hours due to cavitation damage in pumping a heavy, viscous crude oil such as present in these tests.

While the invention has been described in the more limited aspects of a preferred embodiment thereof, other embodiments have been suggested and still others will occur to those skilled in the art upon the reading and understanding of the foregoing specification. It is intended that all such embodiments be included within the scope of this invention as limited only by the appended claims.

Having thus described our invention, we claim:

1. In a method of producing hydrocarbon liquid having an A.P.I. gravity of less than about 15 degrees from a hydrocarbon-bearing formation in which the hydrocarbon liquid is propelled to the surface by a jet pump utilizing a jetted power fluid which entrains the hydrocarbon liquid in a jet stream, the improvement which comprises providing a power fluid comprising a water and surfactant solution and emulsifying the hydrocarbon liquid in the solution within the jet stream whereby heavy, viscous hydrocarbon liquid can be economically produced.

2. The improvement as set forth in claim 1 wherein the step of providing a power fluid further includes the step of providing a hydrocarbon diluent.

3. The improvement as set forth in claim 2 wherein the hydrocarbon diluent is kerosene distillate.

4. The improvement as set forth in claim 2 wherein the hydrocarbon diluent is No. 2 diesel.

5. The improvement as set forth in claim 1 wherein the step of providing a power fluid comprises providing a power fluid having a surfactant concentration of from about 50 to about 300 ppm based on the water phase.

6. The improvement as set forth in claim 5 wherein the step of providing a power fluid further includes the step of providing a hydrocarbon diluent.

7. The improvement as set forth in claim 5 wherein the step of providing a power fluid comprises providing a power fluid containing at least one additional component selected from the group consisting of biocides, oxygen scavengers, and scale inhibitors.

8. The improvement as set forth in claim 7 wherein the step of providing a power fluid comprises providing a power fluid containing 100 ppm surfactant, 60 ppm biocide, 70 ppm oxygen scavenger and 10 ppm scale inhibitor.

9. The improvement as set forth in claim 8 wherein the step of providing a power fluid further includes the step of providing a hydrocarbon diluent.

10. The improvement as set forth in claim 1 wherein power fluid is provided in a ratio of about 7.25 to 1 based on the produced heavy, viscous hydrocarbon liquid.

11. A method for producing heavy, viscous crude oil having an A.P.I. gravity of less than about 15 degrees comprising the steps of:

providing a well bore having a casing into a heavy oil producing formation;

providing a reverse flow jet pump in the well bore, the jet pump having production tubing connected to its discharge orifice and a power fluid intake in fluid communication with an annular space between said casing and said production tubing; and pumping a jet pump power fluid into the annulus, the power fluid comprising water and a surfactant whereby the heavy, viscous crude oil is emulsified within the jet pump and the emulsion is produced through said production tubing.

* * * * *